US007318585B2

(12) United States Patent
Soshiroda

(10) Patent No.: US 7,318,585 B2
(45) Date of Patent: Jan. 15, 2008

(54) IMAGE FORMING APPARATUS

(75) Inventor: Hiroshi Soshiroda, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 112 days.

(21) Appl. No.: 11/370,652

(22) Filed: Mar. 7, 2006

(65) Prior Publication Data

US 2007/0001120 A1 Jan. 4, 2007

(30) Foreign Application Priority Data

Jul. 1, 2005 (JP) ..... 2005-193680

(51) Int. Cl.
*B65H 43/00* (2006.01)

(52) U.S. Cl. ..... 271/176; 271/303; 271/184; 271/186

(58) Field of Classification Search ..... 271/303, 271/304, 184, 185, 186, 176; 399/364, 401
See application file for complete search history.

(56) References Cited

U.S. PATENT DOCUMENTS 5,216,473 A * 6/1993 Maeyama ..... 399/364
5,449,164 A * 9/1995 Quesnel et al. ..... 271/186
5,765,824 A * 6/1998 Kawano et al. ..... 270/58.11
5,784,680 A * 7/1998 Taruki ..... 399/374
5,854,965 A * 12/1998 Kasiwabara et al. ..... 399/381
6,047,960 A * 4/2000 Kawano et al. ..... 271/184
6,478,298 B1 * 11/2002 Mandel ..... 271/298
6,577,844 B2 * 6/2003 Kamei ..... 399/401
2003/0057636 A1 * 3/2003 Ina et al. ..... 271/186
2005/0067777 A1 * 3/2005 Ilda et al. ..... 271/303
2005/0251286 A1 * 11/2005 Yasui ..... 700/230

FOREIGN PATENT DOCUMENTS

JP 05-051158 3/1993
JP 09235069 A * 9/1997

* cited by examiner

*Primary Examiner*—Patrick Mackey
*Assistant Examiner*—Gerald W McClain
(74) *Attorney, Agent, or Firm*—Squire, Sanders & Dempsey L.L.P.

(57) ABSTRACT

An image forming apparatus to reverse a sheet, includes a branched conveyance path branched from a connection point between an entry and conveyance path and a reversal and conveyance path provided downstream of the entry and conveyance path. When a sheet conveyor feeds the sheet from the entry and conveyance path into the reversal and conveyance path, a controller controls a gate member to be opened on the basis of a detection result of a sensor to detect the sheet until a leading edge of the sheet passes the gate member, switches the gate member to be closed before a trailing edge of the sheet reaches the gate member, subsequently switches a sheet reversing and conveying member to rotate reversely after the trailing edge of the sheet passes the gate member, thereby feeding the sheet into the branched conveyance path.

7 Claims, 5 Drawing Sheets

IMAGE FORMING APPARATUS

This application is based on Japanese Patent Application No. 2005-193680 filed on Jul. 1, 2005, which is incorporated hereinto by reference.

BACKGROUND OF THE INVENTION

The present invention relates to a sheet reversing mechanism in an image forming apparatus. More specifically, the invention relates to a mechanism for reversing the sheet to switch the conveyance direction in an image forming apparatus such as a printer.

The image forming apparatus, for example, reads a document image, writes and develops the image onto a photoreceptor applied with high voltage to form a toner image, and transfers and fixes the toner image onto a sheet as a recording paper, and then collects it on a paper ejection tray. At the time of the collection, the sheet is ejected face-up or face-down. Herein, "face-up" is referred to as the state where the surface with an image formed thereon is placed upward, and "face-down" is referred to as the state where the surface with an image formed thereon is placed downward.

As a member for ejecting the sheet in the face-down state, there is provided a sheet reverse section. In Patent Document 1, as shown in FIG. 8, a sheet on which the toner image is fixed is guided to the underside of a feeding-path switching pawl 151 to a conveyer roller pair 121, 122, and then the sheet is fed into a reverse path made up of guide plates 163, 164 by the conveyance roller pair 121, 122. Subsequently, the sheet fed into the reverse path is kept conveyed in the feeding direction (downward) by a conveyance roller pair 131, 132, until the leading edge of the sheet passes the feeding-path switching pawl 153 through the position of the conveyance roller pair 121, 122. Next, when the trailing edge of the sheet passes the position of the conveyance roller pair 121, 122 and its passage is detected by a sheet sensor 157, the reverse drive of the conveyance roller pair 131, 132 as a sheet reversing and conveying member is started, after waiting until the trailing edge of the sheet passes the feeding-path switching pawl 153. Because of this feature, the initial trailing edge of the sheet is guided to the left side of the feeding-path switching pawl 153 in the figure. The sheet reaches a conveyance roller pair 121, 123, and is kept conveyed by the conveyance roller pair 121, 123. The sheet is further conveyed to an ejecting roller pair 141, 142 through a conveyance roller pair 111, 113, and then is ejected on an ejection tray outside the apparatus in the state where the surface with the image formed thereon is placed downward.

Having described an example of the sheet reverse section in the conventional technology disclosed in Patent Document 1, and the similar configuration has generally been used. The feeding-path switching pawl 153 used as the gate member always keeps to urge the sheet by a spring 176B as also shown in the enlarged view of FIG. 4.

However, this method is designed to set the spring pressure for urging the feeding-path switching pawl to be low, particularly considering damage that would be inflicted on a thin paper when the thin paper enters the feeding-path switching pawl. Its behavior will be described below.

There is also a method that presses the sheet using a thin plate of PET serving both as the spring and the feeding-path switching pawl, but from a standpoint of abrasion, it is unsuitable for a high speed machine.

[Patent Document 1] Unexamined Japanese Patent Publication No. 05-51158

As described above, the conventional methods have been required to set, for example, the pressure of the spring as a resilient member for urging the feeding-path switching pawl to be low, particularly considering the damage in the entrance of the thin paper into the feeding-path switching pawl, namely, the occurrences of a leading edge trace of the thin paper and a paper jam. Thus, the control force of the feeding-path switching pawl to the sheet is weak and the response of the sheet trailing edge is bad, so that it has been difficult to immediately stop the sheet in the always same position to switch the conveyance direction after the sheet trailing edge passes the feeding-path switching pawl 153. Consequently, the reverse point at which the conveyance direction is switched has had to be located downstream the just end of the feeding-path switching pawl. As a result, the image output productivity has lowered. In order to avoid the lowering of the productivity, it is required to increase the conveyance speed of the sheet after the conveyance direction is switched. However, the motor noise grows louder as the conveyance speed is increased, which has not been preferred.

SUMMARY OF THE INVENTION

The invention has the following configuration.

An image forming apparatus which reverses a sheet includes the following: an entry and conveyance path through which the sheet is conveyed; a reversal and conveyance path provided downstream in the sheet conveyance direction relative to the entry and conveyance path; a branched conveyance path branched from a connection point between the entry and conveyance path and the reversal and conveyance path; a sheet conveyor for conveying the sheet, provided in the entry and conveyance path; a gate member that can open and close and is provided at the connection point between the entry and conveyance path and the reversal and conveyance path; a sheet reversing and conveying member that can be rotated forwardly and reversely for conveying the sheet and is provided in the reversal and conveyance path; a sheet sensor for detecting the sheet, provided in the upstream side in the sheet conveyance direction relative to the gate member; and a controller for controlling the gate member and the sheet reversing and conveying member based on the detection result by the sensor. The controller provides control so as to keep the gate member in an open state until the leading edge of the sheet passes the gate member, when feeding the sheet into the reversal and conveyance path from the entry and conveyance path by the sheet conveyor, based on the detection result of the sensor; switch the gate member to a close state before the trailing edge of the sheet reaches the gate member; subsequently switch the sheet reversing and conveying member to the reverse rotation after the trailing edge of the sheet passes the gate member; and feed the sheet into the branched conveyance path.

DETAILED DESCRIPTION OF THE PREFERRED EMBODIMENT

Hereinafter, the preferred embodiment of an image forming apparatus of the invention will be described. It is to be understood that the description of this section does not limit the technical scope of the claim and the definitions of terms. In addition, the decisive description in the embodiment of the invention is to represent the best mode, and is not to limit the definitions of terms or the technical scope of the claim.

Figure 1:
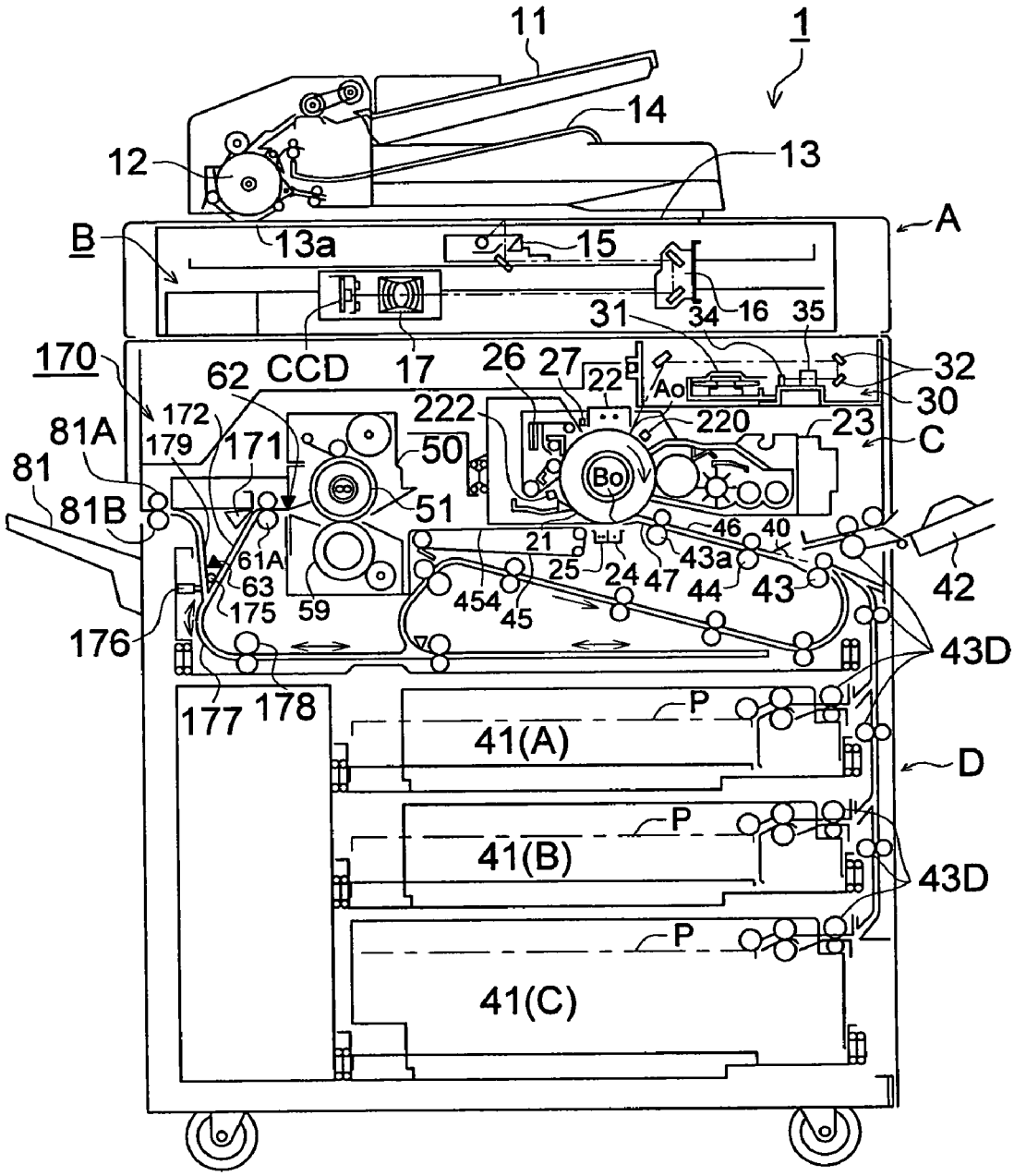
FIG. 1 is a general configuration view showing an example of an image forming apparatus of the invention.

An image forming apparatus 1 shown in FIG. 1 is an image forming apparatus of the digital system, which is provided with an image reading section A, an image processing section B, an image forming section C, and a sheet feeding and conveying section D for feeding and conveying sheet P as recording paper. However, the image forming apparatus according to the invention is not limited to the above described one, and may be applied to inkjet printers or printing machines.

Provided in an upper portion of the image reading section A is an automatic document feeder for automatically conveying the document. The documents on a document placing table 11 is separated as a single sheet of paper by a document conveyance roller 12 to carry out the image reading in a reading position 13*a*. The document having been subjected to document reading is ejected onto a document ejection tray 14 by the document conveyance roller 12.

In the case when the document is placed on a platen glass 13, the image of the document is read by the reading action of a first mirror unit 15 provided with a lighting lamp and a first mirror that make up a scanning optical system at velocity v, and by the movement of a second mirror unit 16 provided with a second mirror and a third mirror that are placed in a V-shape at velocity v/2 in the same direction.

The read image is formed on a receiving surface of an imaging element CCD which is a line sensor through a projection lens 17. The linear optical image that is formed on the imaging element CCD is photoelectrically converted into electrical signals (luminance signals) in order. The electrical signals are A/D converted, and subjected to processes such as density conversion and filtering in the image processing section B. The image data is temporarily stored in a memory.

In the image forming section C, a drum-shaped photoreceptor 21 which is an image carrier is provided on a periphery thereof with a charger 22 for charging the photoreceptor 21, a potential detector 220 for detecting the surface potential of the charged photoreceptor, a developing device 23, a transfer electrode 24 and separation electrode 25 which are a transfer and separation device, a cleaning device 26 of the photoreceptor 21, and a PCL (pre-charge lamp) 27 as a light discharger, which are arranged in the order of the actions respectively as an image forming unit. Further, provided in the downstream side of the developing device 23 is a reflectance density detector 222 for measuring the reflectance density of a patch image developed on the photoreceptor 21. The photoreceptor 21 is formed such that the photoconductive compound is coated on a drum base, and for example, an organic photoconductor (OPC) is preferably used therein. The photoreceptor 21 is driven and rotated in the clockwise direction shown in the figure.

The rotating photoreceptor 21 is uniformly charged by the charger 22. Then, the imagewise exposure is carried out based on the image signal called from the memory of the image processing section B, by an exposure optical system 30 as an imagewise exposure device. The exposure optical system 30 as the imagewise exposure device which is a writing device serves as the main scanning in which the optical path is bended by a reflection mirror 32 through a rotating polygon mirror 31, an fθ lens 34, and a cylindrical lens 35, with a laser diode not shown as an emission source. The imagewise exposure is applied to the photoreceptor 21 in the position Ao and a latent image is formed by the rotation (sub-scanning) of the photoreceptor 21. In an example of the embodiment, the exposure is applied to the character part to form a latent image.

The latent image on the photoreceptor 21 is reversed and developed by the developing device 23, and a visible toner image is formed on a surface of the photoreceptor 21. The sheet feeding and conveying section D is provided below the image forming unit with paper feeding units 41(A), 41(B), 41(C) as sheet storing devices in which the sheet P as the recording paper of different size is accommodated respectively, and with a conveyance roller 43D. It is further provided laterally with a hand feeding unit 42 for manually feeding. The sheet P selected from any of the feeding units is fed along a conveyance path 40 by a guide roller 43, and temporarily stopped by a registration roller pair 44 that corrects the skew and shift of the sheet P to be fed, and then is fed again. The sheet P is guided to the conveyance path 40, a pre-transfer roller 43*a*, a paper feeding path 46 and an entrance guide plate 47, in which the toner image on the photoreceptor 21 is transferred onto the sheet P by the transfer electrode 24 and the separation electrode 25 in the transfer position Bo. Then, the sheet P is separated from the surface of the photoreceptor 21, while being set on and conveyed by a conveyance belt 454 of a conveyance belt device 45, and conveyed to a fixing device 50 by the conveyance belt device 45.

The fixing device 50 has a heat roller 51 as a rotation body drive member with a heat source as a heater, and a pressure roller 59 without a heat source as a heater. The sheet P is passed through between the heat roller 51 and pressure roller 59 to fix the toner by heating and pressure. The sheet P on which the toner image has been fixed is ejected to a paper ejecting section 81 through a paper ejecting roller pair 81A, 81B, in the state of face-down in which the sheet is reversed by a sheet reverse section 170.

Figure 2:
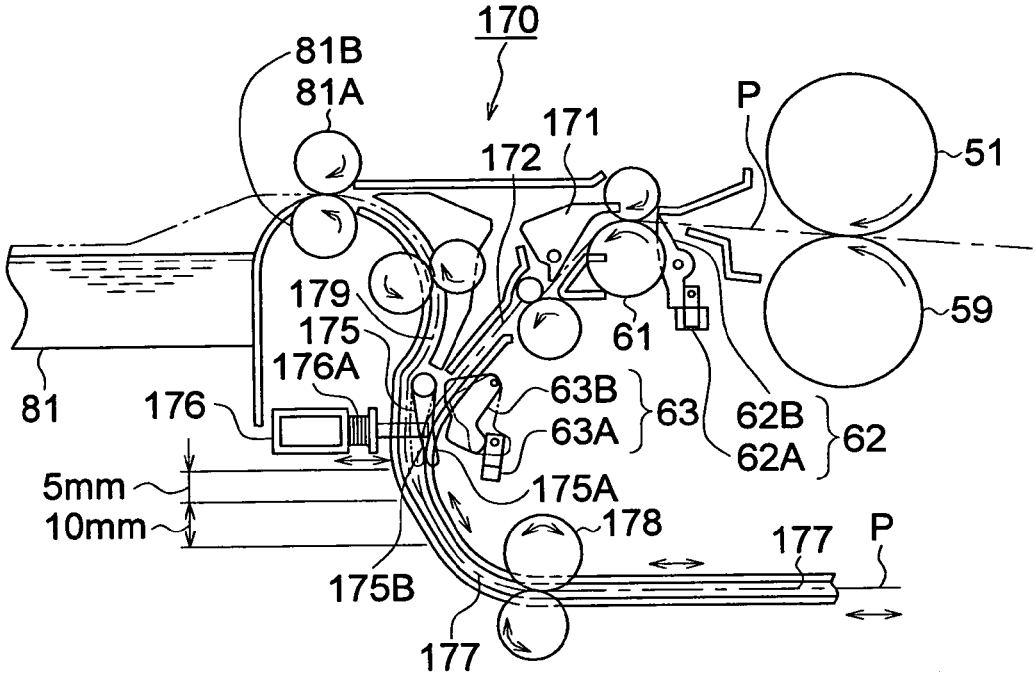
FIG. 2 is a general configuration view showing a sheet reverse section incorporated in the invention.

The configuration and function of the sheet reverse section 170 will be described also using the configuration view of FIG. 2.

In the downstream side next to the fixing device 50, there are provided an entrance detection sensor 62 for detecting a sheet at an entrance gate 171 of the sheet reverse section 170, a conveyance roller pair as a sheet conveyor 61 for feeding a sheet, the entrance gate 171, a reversal timing sensor 63, a gate member 175 which is closed by the pressing force of a spring 176A as a resilient member allowing the sheet to pass through and is opened by a solenoid 176 as a forced opening and closing device, and a sheet reversing and conveying member 178 which can be rotated forwardly and reversely, which are arranged in the description order along the conveyance path. Of the conveyance path, the upstream from the above described gate member 175 is an entry and conveyance path 172 and the downstream is a reverse conveyance path 177. The conveyance path is further provided with a branched conveyance path 179 from the switched gate member 175 to the paper ejecting section 81.

The action of the sheet reverse section 170 having such a configuration and a controller 200 will be described using the block circuit diagram of FIG. 5 and the time chart of FIG. 6.

Figure 5:
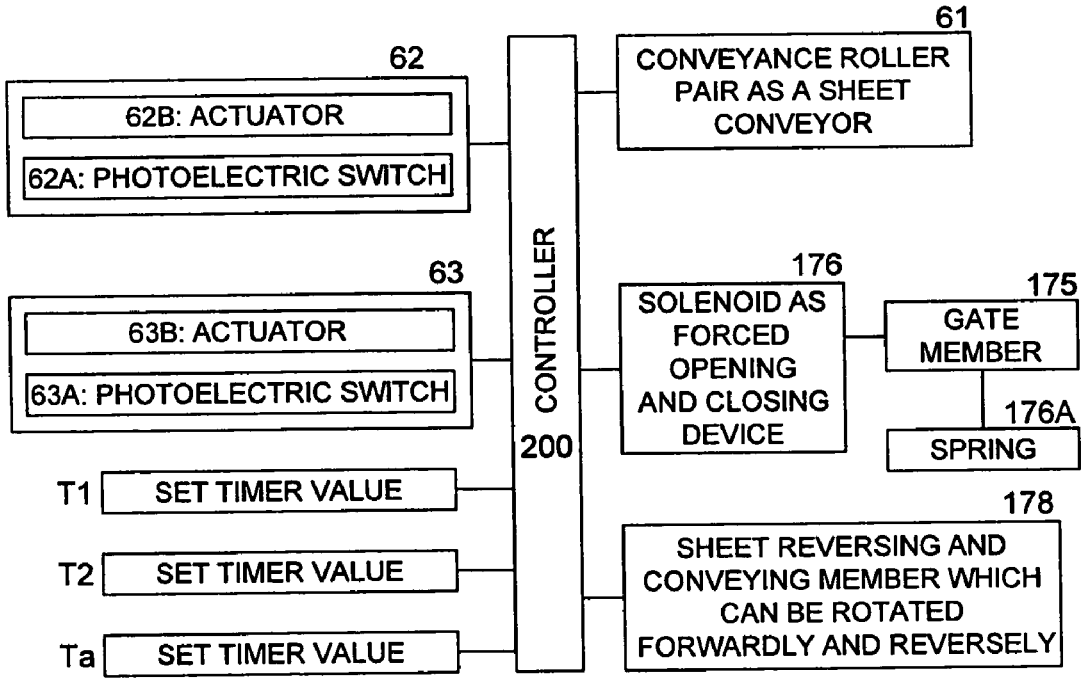
FIG. 5 is a block circuit diagram showing a controller of the invention.

As shown in the block circuit diagram of FIG. 5, there are provided an entrance sensor 62 made up of an actuator 62B and a photoelectric switch 62A and a reversal timing sensor made up of an actuator 63B and a photoelectric switch 63A. The information of set timer values T1, T2, Ta for the detection values of the above sensors is input to the controller 200. The powers of the sheet conveyor 61 and solenoid 176 are respectively turned on and off based on an instruction of the controller 200 in response to the information corresponding to each of the set timer values. Thereby, the gate member 175 and the spring 176A as the resilient member are activated, and the sheet reversing and conveying member 178 which can be rotated forwardly and reversely is activated as well.

Figure 6:
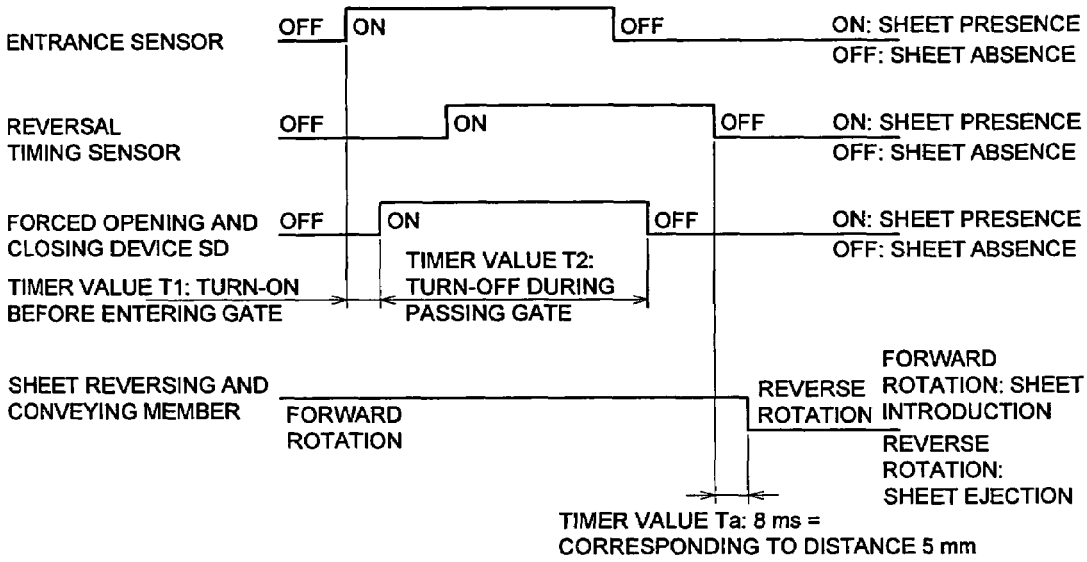
FIG. 6 is a time chart showing the controller of the invention.

Further, as also shown in the time chart of FIG. 6, the sheet P on which the toner image has been fixed is detected by the entrance sensor 62. The sheet P is just driven to the fixing device 50, passes the conveyor roller pair 61 as the sheet conveyor, and is conveyed through the opened entrance gate 171 and the entry and conveyance path 172 of the sheet reverse section 170 in the state where the gate member 175 is opened, without any load imposed by the gate member 175. Incidentally, the gate member 175 is opened when the timer works to reach the timer value T1 after the entrance sensor 62 has detected the sheet P. At the time when the timer reaches the timer value T1, the leading edge of the sheet P does not reach the gate 175 yet.

Incidentally, instead of the sheet conveyor 61 to the entrance gate 171 of the sheet reverse section 170, the roller pair by the fixing device 50 may be used as the sheet conveyor.

After the leading edge of the sheet P passes the gate member 175 and when the timer reaches the timer value T2 following the timer value T1, the gate member 175 which has been forced opened by the solenoid 176 is closed, and thereby a guide surface 175A of the gate member 175 urges the sheet surface with the pressing force F of the spring 176A as the resilient member.

It is further preferable that the guide surface 175A of the gate member 175 is designed to keep the state of urging the sheet surface with the pressing force F of the spring 176A as the resilient member, by closing the gate member 175 which has been forced opened by the solenoid 176, after the leading edge of the sheet P passes the gate member 175 and reaches the conveyance roller pair which is the sheet reversing and conveying member 178 which can be rotated forwardly and reversely, as well as after the timer value T2 passes following the timer value T1, because the conveyance resistance of the sheet P can be avoided.

Figure 7:
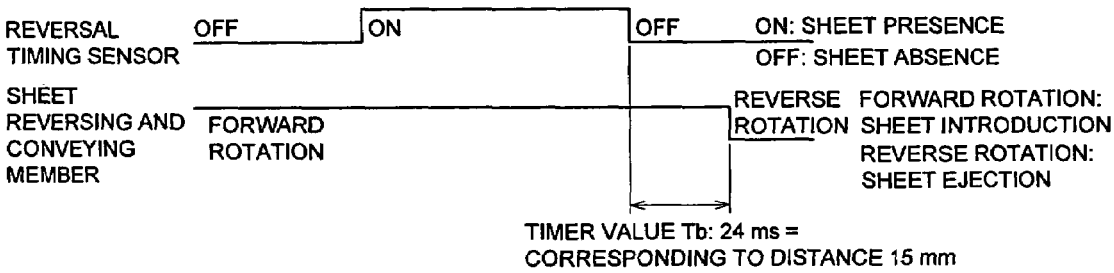
FIG. 7 PRIOR ART
FIG. 7 is a time chart of the controller in the conventional technology as the background art.
Figure 8:
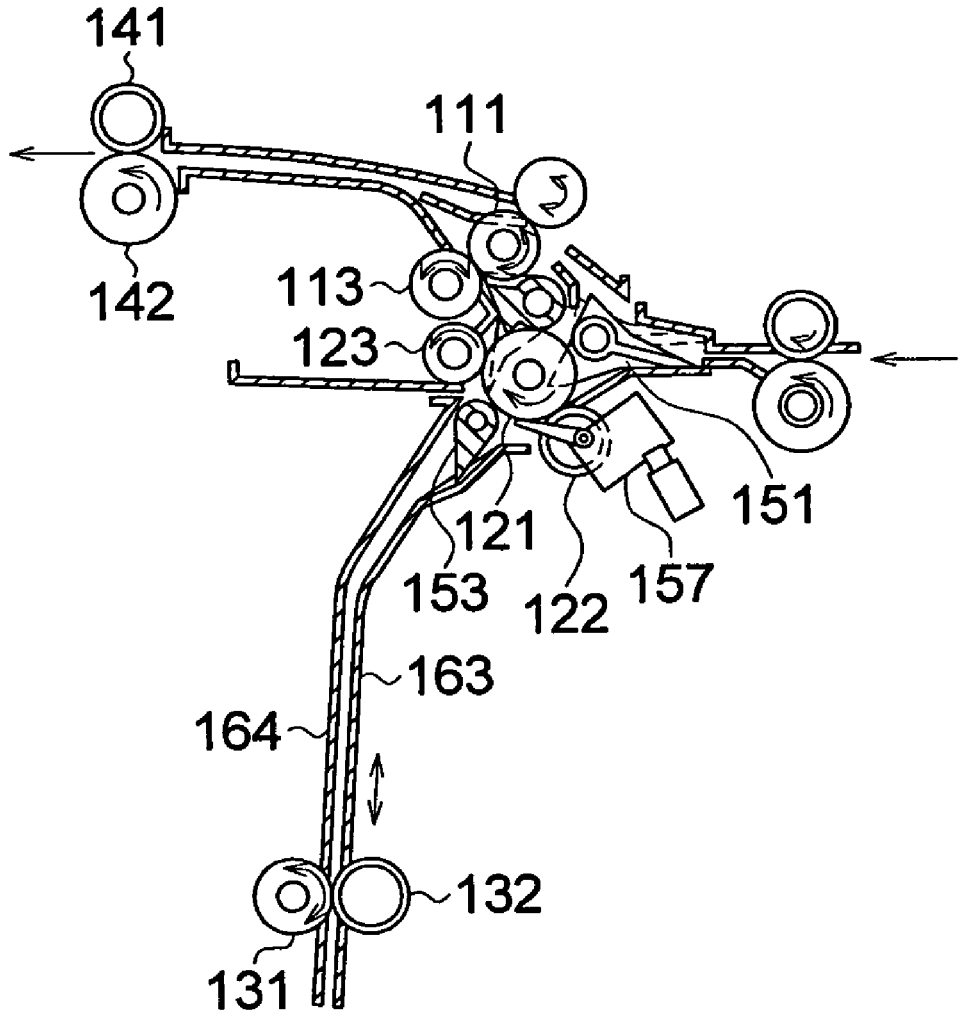
FIG. 8 PRIOR ART
FIG. 8 is a general configuration view showing the sheet reverse section of the conventional technology.

Subsequently, the reversal timing sensor 63 detects the sheet trailing edge and the timer works as well. The timer value Ta can be set to smaller than the timer value Tb as shown in the time chart of the conventional example of FIG. 7. Incidentally, it can be seen that 8 ms of the timer value Ta in the invention is smaller than 24 ms of the conventional timer value Tb. The former corresponds to a distance of 5 mm when the sheet is conveyed at high speed with a linear velocity of 700 mm, and the latter corresponds to a distance of 15 mm. Thus, the invention makes it possible to switch the conveyance direction at a position further upstream than in the conventional technology, and it is possible to substantially raise the sheet conveyance efficiency in the image forming apparatus required to realize a high speed output. In addition, as an error of about +10 mm may occur in the distance due to the mechanical assembling accuracy or controlled accuracy, a difference of at most about 20 mm may occur between in the conventional example and the invention.

Figure 3:
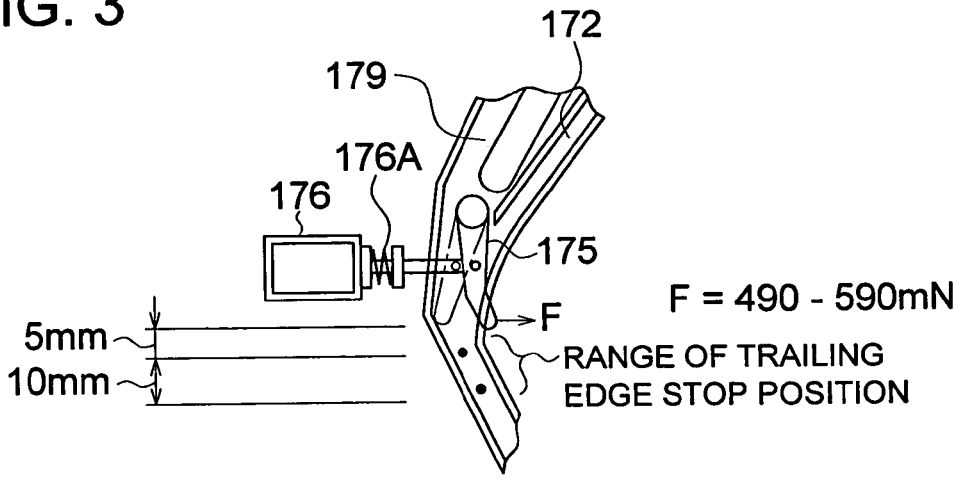
FIG. 3 is a partial enlarged view showing the vicinity of a gate member in the sheet reverse section of the image forming apparatus of the invention.
Figure 4:
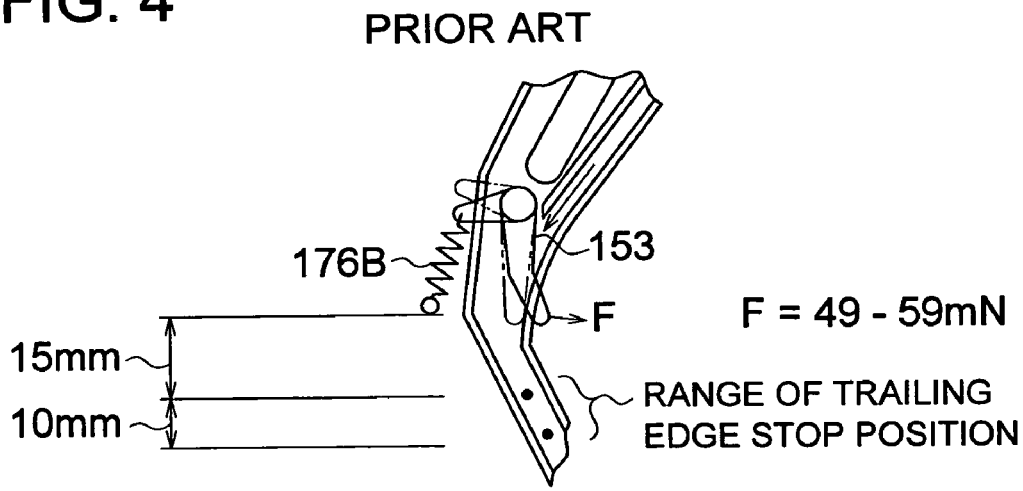
FIG. 4 is a partial enlarged view showing the vicinity of a feeding-path switching pawl of the sheet reverse section which is a gate member of the conventional technology.

The difference of the reverse point at which the conveyance direction is switched is schematically shown in the partial enlarged view in the vicinity of the gate member of the invention shown in FIG. 3 and the partial enlarged view in the vicinity of the feeding-path switching pawl which is the gate member of the conventional example shown in FIG. 4.

As described in the background of the invention, conventional switching of the conveyance path is carried out by the method that the feeding-path switching pawl is in the state of being pressed against the sheet conveyance path by the spring or the thin plate of PET so that the sheet passes through the spring or the thin plate counter to the urging force thereof. Thus, the increased pressing force may cause the leading edge trail left when the sheet leading edge passes through or the occurrence of a paper jam, so that the pressing force F is set to a lower value ranging from 49 to 59 mN. When the sheet trailing edge passes through and moves to the reverse and conveyance path, the timer value Tb has had to be set so that the stop position of the sheet trailing edge is located in the downstream side, because the control force to the sheet is weak and the response of the sheet trailing edge is bad.

On the other hand, the gate member used in the invention, when the sheet leading edge passes through, is forced opened enough to allow the sheet to pass through without load, for example, by the solenoid, so that the leading edge trail is not left and the paper jam can be prevented. Further, the gate surface is urged by substantially strong pressing force F ranging from 490 to 590 mN when the leading edge does not passes through, and an appropriate control force is applied to the sheet, so that the response of the sheet trailing edge is good, and the stop position of the sheet trailing edge can be located further upstream than in the conventional technology. This makes it possible to avoid the event involving the occurrence of unpleasant motor noise when the reverse speed of the sheet is substantially increased, as well as to increase the image output productivity.

As described above, at the time when the sheet trailing edge reaches the position downstream the gate member 175 and in the vicinity of the gate member 175, the conveyance before reversal is completed. Then the sheet reversing and conveying member which can be rotated forwardly and reversely starts the reverse drive. The sheet P is conveyed through the branched conveyance path 179 to the paper ejecting section 81 with a guide surface 175B opposite to the guide surface 175A of the switched gate member 175 as a guide. Thereby, the sheet P reaches the paper ejecting section 81.

In this embodiment, the opening and closing operation of the gate member 175 is controlled based on the detection of the entrance sensor 62 placed upstream the reversal timing sensor 63. Because of this feature, the spacing between the reversal sensor 63 and the gate member 175 is narrow, so that the opening and closing timing of the gate member 175 can be precisely performed in the apparatus that conveys the sheet P at high speed. However, the invention is not limited to this embodiment, and can be designed that the opening operation of the gate member 175 is carried out based on the detection information by the entrance sensor 62 and the closing operation is carried out based on the detection information of the reversal timing sensor 63. It can be also designed that a common sensor serving both as the entrance sensor 62 and the reversal timing sensor 63 is provided upstream the gate 175 to control both of the gate member 175 and the sheet reversing and conveying member 178, based on the detection information of the relevant sensor and the timer value.

The image forming apparatus of the invention is not limited to the above context, and can be applied to inkjet printers, printer machines and other related machines.

According to the embodiment, the occurrences of the leading edge trail and paper jam are suppressed even with the thin sheet, the control force to the sheet trailing edge works, and the response of the sheet trailing edge becomes good, so that it is possible to locate the reverse point at which the sheet conveyance direction is switched in the upstream side. This makes it possible to raise the sheet conveyance efficiency after image forming as well as to increase the image output productivity.

Further, the present invention can be applied not only to the reversing mechanism of the sheet which is the recording paper on which the image to be recorded, but also to the reversing mechanism to the sheet of the document. Particularly, when it is applied to an apparatus for reversing the document before reading the image of the document, the document conveyance efficiency rises with the document reading speed improved.

What is claimed is:

1. An image forming apparatus which reverses a sheet, comprising:

(a) an entry and conveyance path through which the sheet is conveyed;

(b) a reversal and conveyance path provided downstream in a sheet conveyance direction with respect to the entry and conveyance path;

(c) a branched conveyance path branched from a connection point between the entry and conveyance path and the reversal and conveyance path;

(d) a sheet conveyor provided in the entry and conveyance path for conveying the sheet;

(e) a gate member capable of being opened and closed, which is provided at a connection point between the entry and conveyance path and the reversal and conveyance path;

(f) a sheet reversing and conveying member provided in the reversal and conveyance path, capable of rotating forwardly and reversely for conveying the sheet;

(g) a sheet sensor provided upstream of the gate member in the sheet conveyance direction for detecting the sheet; and (h) a controller for controlling the gate member and the sheet reversing and conveying member based on a detection result of the sheet sensor, wherein when the sheet conveyor feeds the sheet from the entry and conveyance path into the reversal and conveyance path, the controller controls the gate member to be opened on the basis of a detection result of the sensor until a leading edge of the sheet passes the gate member, switches the gate member to be closed before a trailing edge of the sheet reaches the gate member, subsequently switches the sheet reversing and conveying member to rotate reversely after the trailing edge of the sheet passes the gate member, thereby feeding the sheet into the branched conveyance path.

2. The image forming apparatus of claim 1, wherein the controller switches the gate member to be closed after the leading edge of the sheet passes the gate member, after the leading edge reaches the sheet reversing and conveying member, and before the trailing edge of the sheet reaches the gate member.

3. The image forming apparatus of claim 1, further comprising a solenoid which opens and closes the gate member, and a resilient member which urges the gate member to be closed.

4. The image forming apparatus of claim 3, wherein the controller controls the gate member to be opened counter to urging force of the resilient member by turning the solenoid on, and controls the gate member to be closed with the urging force of the resilient member by turning the solenoid off.

5. The image forming apparatus of claim 1, wherein the sheet sensor comprises an entrance detection sensor provided in the entry and conveyance path and a reversal timing sensor provided between the entrance detection sensor and the gate member, and wherein the controller controls an opening and closing operation of the gate member on the basis of detected information by the entrance detection sensor, and a forward and reversal rotation of the sheet reversing and conveying member on the basis of detected information by the reversal timing sensor.

6. The image forming apparatus of claim 5, wherein after the reversal timing sensor detects the trailing edge of the sheet, the controller controls the sheet reversing and conveying member to switch from a forward rotation to a reverse rotation, on the basis of a predetermined timer value.

7. The image forming apparatus of claim 6, wherein after a predetermined period of time T1 passes after the entrance detection sensor detects the leading edge of the sheet, the controller controls the gate member to be opened, after a predetermined period of time T2 passes after the gate member is opened, the controller controls the gate member to be closed, and thereafter the controller controls the sheet reversing and conveying member to switch from the forward rotation to the reverse rotation after a predetermined period of time Ta passes after the reversal timing sensor detects the trailing edge of the sheet.

* * * * *